US007191747B2

(12) United States Patent
Kramer

(10) Patent No.: US 7,191,747 B2
(45) Date of Patent: Mar. 20, 2007

(54) METHOD FOR STARTING AN INTERNAL COMBUSTION ENGINE

(75) Inventor: Ulrich Kramer, Bergisch Gladbach (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/324,965

(22) Filed: Jan. 3, 2006

(65) Prior Publication Data

US 2006/0150938 A1 Jul. 13, 2006

(30) Foreign Application Priority Data

Jan. 10, 2005 (EP) ..... 05100082

(51) Int. Cl.
*F01L 13/08* (2006.01)
*F02D 33/00* (2006.01)

(52) U.S. Cl. ..... 123/182.1; 123/179.16; 123/179.5

(58) Field of Classification Search ..... 123/179.3, 123/179.4, 179.5, 179.16, 182.1
See application file for complete search history.

(56) References Cited

U.S. PATENT DOCUMENTS 6,050,231 A * 4/2000 Tisch et al. ..... 123/179.1
6,050,232 A * 4/2000 Grob et al. ..... 123/179.16
6,098,585 A * 8/2000 Brehob et al. ..... 123/179.5
6,340,016 B1 1/2002 Ueda et al.
6,718,928 B2 * 4/2004 Brueggen et al. ..... 123/179.5
6,739,300 B2 * 5/2004 Ackermann et al. ..... 123/179.5
6,910,457 B2 * 6/2005 Grieser et al. ..... 123/198 DB
7,104,235 B2 * 9/2006 Brehob et al. ..... 123/179.5
2001/0025621 A1 10/2001 Shiraishi et al.
2002/0166531 A1 * 11/2002 Ackermann et al. ... 123/179.16
2005/0006901 A1 1/2005 Umiastowski

FOREIGN PATENT DOCUMENTS

DE 4230616 3/1994
DE 19527503 1/1997
DE 19808472 9/1999
DE 10024438 11/2001
DE 10328123 1/2004

* cited by examiner

*Primary Examiner*—Noah P. Kamen
*Assistant Examiner*—Arnold Castro
(74) *Attorney, Agent, or Firm*—Donald J. Lewis

(57) ABSTRACT

The description relates to a method for starting a direct-injection internal combustion engine equipped with an engine management system and having n cylinders, in which n pistons oscillate between a top dead center (TDC) and a bottom dead center (BDC), and a crankshaft. It is proposed to set forth a method of the aforesaid type which overcomes the known disadvantages inherent in the state of the art known, the particular intention being to achieve a shortening of the starting times.

18 Claims, 6 Drawing Sheets

METHOD FOR STARTING AN INTERNAL COMBUSTION ENGINE

The present application claims priority to EP 05100082.6, titled METHOD FOR STARTING AN INTERNAL COMBUSTION ENGINE, filed Jan. 10, 2004, the entire contents of which are incorporated herein by reference in their entirety for all purposes.

FIELD

The present description relates to a method for starting a direct-injection internal combustion engine equipped with an engine management system and having a crankshaft and n cylinders, in which n pistons oscillate between a top dead center (TDC) and a bottom dead center (BDC)

BACKGROUND AND SUMMARY

Owing to the limited fossil fuel resources and in particular to the limited deposits of mineral oil as raw material for the extraction of fuels for the operation of combustion engines, efforts are constantly being made in the development of internal combustion engines to minimize fuel consumption, the primary focus of these efforts being an improved, that is to say a more efficient combustion. On the other hand, however, specific strategies with regard to the basic operating principle of the internal combustion engine may also be suited to this object.

One concept for improving the fuel consumption of a vehicle, for example, is to shut the internal combustion engine off—instead of allowing it to continue to idle—when there is no instantaneous power demand. In practice the internal combustion engine may be switched off at least when the vehicle is stationary. One application of this is in the stop-go traffic such as occurs, for example, in the traffic congestion on interstate and main highways. In urban driving, stop-go traffic due to the existence of uncoordinated traffic light systems is now even the rule rather than the exception. Barrier-type rail crossings and the like represent other possible applications.

A problem with concepts, which in the absence of demand shut off the internal combustion engine in order to improve the fuel consumption, is the need to restart the internal combustion engine. Restarting presents problems among other things because in uncontrolled shutting-off of the internal combustion engine, the crankshaft and the camshaft come to rest in any unknown position. Consequently the position of the pistons in the individual cylinders of the internal combustion engine is likewise unknown and left to chance. This information, however, is essential for uncomplicated restarting in the shortest possible time with the maximum possible fuel-saving.

In an internal combustion engine, which is equipped with electronically controlled ignition and/or electronically controlled fuel injection, markers arranged on the crankshaft and/or the camshaft deliver crankshaft angular position signals to sensors connected to the engine management system for controlling the ignition timing and the injection timing. In order to generate these signals, however, it is first necessary to set the crankshaft into rotation. Right at the beginning of a starting sequence the correct injection and ignition timing are generally unclear, so that a run-in phase is necessary for synchronization of the crankshaft position on the one hand and the engine operating parameters on the other.

Knowledge of the position of the individual cylinders, that is to say knowledge of the position of the individual pistons of an internal combustion engine is necessary, in order that the injection of the fuel and the initiation of the ignition of the fuel-air mixture in the individual cylinders can be performed accurately, that is to say at defined crankshaft angles, in order to thus ensure an optimum combustion with the lowest possible fuel consumption and lowest possible emissions. Furthermore, accurate injection and ignition are necessary in order to prevent self-ignition of fractions of the mixture—so-called knocking—and to ensure the smoothest, that is to say the most uniform possible running of the internal combustion engine, which is distinguished by minimum rotational oscillations of the crankshaft and hence by minimum rotational speed fluctuations. The task of controlling the injection and ignition is generally undertaken by an engine management system.

In the state of the art the position of the individual cylinders of an internal combustion engine is determined by a camshaft sensor and a crankshaft sensor, also referred to as a crank angle sensor.

The fixed crankshaft sensor arranged on the internal combustion engine here reads off signals from a ring or toothed ring, which rotates with the crankshaft and which may be provided, for example, on the flywheel. The signal generated by the crankshaft sensor is needed by the engine management system in order to calculate the rotational speed and the angular position of the crankshaft. The engine management system needs these data in order to calculate the ignition setting, the fuel injection and the fuel quantity under all operating conditions of the internal combustion engine, knowledge of the rotational speed and angular position of crankshaft being the most important items of information generated by a crankshaft sensor.

Although the rotational speed and angular position can in principle also be determined by a camshaft sensor, the rotational speed should be determined as precisely as possible, in order to ensure correct, optimum running of the internal combustion engine, for which reason the state of the art still relies on the crankshaft sensor for this purpose, since the crankshaft rotates at twice the rotational speed of the camshaft and thereby delivers a signal with a significantly higher resolution. The crankshaft sensor is also capable of producing a higher resolution because the flywheel arranged on the crankshaft can accommodate a large number of teeth or other signal generators by virtue of its relatively large diameter.

Moreover, the piston position can be determined that much more accurately by evaluating a crankshaft signal than by a camshaft signal, since the camshaft, for drive purposes, is connected to the crankshaft by way of a relatively soft drive (generally a belt or chain drive). This shows that the camshaft may not synchronously follow the movements of the crankshaft and this results in deviations of the camshaft signal from the crankshaft signal.

The camshaft sensor is needed in order to be able to determine whether the cylinder and the piston is in the combustion cycle—compression and expansion—or in the charge cycle—exhaust and induction. The crankshaft sensor only determines the position of the piston in a crank angle window of 360°. On the basis of the information from the crankshaft sensor it is possible to determine, for example, whether the piston is at top dead center (TDC) or bottom dead center (BDC). Since in a four-stroke internal combustion engine an operating cycle consisting of compression, expansion, exhaust and induction covers a crankshaft angle (CA) of 720°, however, it is essential to know whether a piston at top dead center (TDC) is at the so-called ignition TDC (ITDC) or at the charge cycle (overlap) top dead center (OTDC). This information is supplied by the camshaft sensor, so that the piston position can be clearly determined through the interaction of the camshaft sensor and the crankshaft sensor.

In practice, the position of just one individual cylinder of the internal combustion engine is usually determined by said sensors, thereby establishing the position of the other cylinders. Knowing the position of an individual cylinder, the engine management system is able to calculate the ignition timing and the injection timing for this one cylinder. With the information on the firing order of the internal combustion engine filed in the engine management system it is then possible to obtain the ignition timings and the injection timings of the other cylinders.

A distinction must be made here between the terms injection angle and ignition angle, which follow the position of the crankshaft, and the terms ignition timing and injection timing. An injection angle might be 15° CA BTDC, whereas the injection timing must be understood to mean that the engine management system, knowing the position of the piston and the rotational speed, calculates the time at which injection occurs.

The principle of the method, which uses the two sensors, that is to say the camshaft sensor and the crankshaft sensor, to determine the cylinder position, assumes that the internal combustion engine is in operation and the camshaft and the crankshaft are rotating fast enough to enable the sensors to deliver a signal to the engine management system.

In the state of the art various concepts are proposed in order to facilitate restarting.

The German published patent application DE 42 30 616, for example, proposes to store the angular position of the crankshaft registered at the time of shutting off, and to use this for restarting, so that the suitable ignition timings and injection timings are immediately available. Should this stored information on the last position of the cylinders be no longer available when restarting, because it has been lost when the battery was removed and there was no power supply to the engine management system, for example, the state of the art allows for injection and ignition at any point when starting, the internal combustion engine, with the aid of the engine management system, adjusting to the required operating point within a couple of operating cycles. Even with a power supply, however, it has been shown in practice that the angular position of the stationary crankshaft can only be detected very imprecisely with the conventional sensors. In this context there are problems stemming from the fact that the crankshaft, at the end of the rundown sequence can also turn backwards, that is to say counter to its actual running direction, since the compressed gases in individual cylinders endeavor to expand.

Other attempts at a solution prefer methods for controlled shut-off and starting of the internal combustion engine. The controlled shut-off entails deliberately running to quite specific crank angle positions—so-called preferred positions—when shutting off the internal combustion engine. In this case the final position of the crankshaft is no longer left to chance and registered more or less accurately, crank angle positions advantageous for restarting instead being purposely adopted.

A further disadvantage of the proposed strategy, in which the internal combustion engine is shut off in the absence of any demand, in order to improve the fuel consumption, is the fact that the stop-go operation increases the demands on the starting device. For one thing the number of start sequences increases if the internal combustion engine is shut off more frequently, which calls for a correspondingly robust starting device adapted to the increased demands. For another, the starting sequence, which can take up to one second, has an adverse effect on running dynamics, and the starting noises affect the level of comfort.

In a conventional internal combustion engine having a conventional starting device, for example a starter or similar unit capable of forcing the crankshaft to rotate, such as an electric motor, for example, the internal combustion engine is started or restarted by activating the starting device and setting the crankshaft into rotation. In so doing the starting device is used to forcibly drive the crankshaft until the engine management system is synchronized and the internal combustion engine is capable of maintaining the rotation of the crankshaft without the starting device, by fuel injection and ignition of the fuel-air mixture.

Throughout the entire synchronization and beyond, until the idling speed of approximately 700 rpm is attained by virtue of the combustion processes in the individual cylinders, the starting device remains activated. The time-consuming synchronization, in particular, is responsible for the long starting times in conventional methods for starting an internal combustion engine.

In order to be able to operate an internal combustion engine in a manner consistent with the demand, especially with a view to the increasing stop-go traffic, that is to say to be able to shut it off in the absence of demand, it is therefore necessary to simplify the restarting, that is to say to make it faster and more fuel-saving. In the state of the art various concepts are proposed for achieving this aim.

The German published patent application DE 198 08 472 A1 describes a method for starting a direct-injection internal combustion engine, in which in the preliminary stages of ignition the crankshaft, in a first step of the method, is slowly turned by a drive into a position in which the piston of a cylinder is situated at top dead center (TDC). A subsequently initiated first ignition command causes the crankshaft to experience a small further rotational movement, initiating the expansion stroke. During the ensuing expansion phase fuel is injected into at least one cylinder and the fuel-air-mixture present in the cylinder is ignited, triggering or initiating the actual starting sequence.

The object of DE 198 08 472 A1 is to set forth a method of engine starting which manages with a substantially smaller current. The reasoning behind this is that starting an internal combustion engine requires substantially larger currents than normal running or normal operation of the internal combustion engine, for which reason the design of a vehicle battery, as a compromise solution, must take account of two load cases.

The initial rotation of the crankshaft and positioning of a piston at top dead center (TDC) is intended to bring the piston of a cylinder into a stable position, in which the piston is not driven forwards by an expanding cylinder charge and in which no reverse rotation occurs owing to the reversal of an incomplete and uncompleted compression.

In a departure from this DE 198 08 472 A1 proposes an alternative method, in which the piston of a cylinder is brought into a position just after the TDC-position through a driven rotation of the crankshaft.

The rotational movement of the crankshaft generated by a drive at the start of the method is not comparable with the forcible rotation of the crankshaft initiated by a starting device, which is already an integral part of the actual starting sequence, whereas the positioning of the piston according to DE 198 08 472 A1 is to be regarded only as preparation for starting.

Given a suitable position of the stationary crankshaft, in which a piston is already at top dead center (TDC) or just after top dead center (TDC), restarting from stationary is then even possible without the starter. In the process, fuel is injected directly into the combustion chamber of the corresponding cylinder of the stationary internal combustion engine and ignited by a spark plug, so that the firing of the air-fuel mixture sets the piston in motion, causing the crankshaft to rotate.

The German published patent application DE 100 24 438 A1 describes a similar method for starting an internal combustion engine. In this method also, in a so-called positioning phase, an electrical machine brings the crankshaft into a start position prior to each starting sequence, this start position being characterized in that the piston of at least one cylinder is brought into a position before top dead center (TDC).

In the ensuing starting phase an initial combustion with reduced compression and reduced volumetric efficiency is initiated in at least one cylinder, which is in the compression phase, this combustion being intended to support the torque of the electrical machine acting on the crankshaft in the starting phase.

A disadvantage to the two methods described in the state of the art is that prior to each starting sequence a positioning phase is necessary, in which the piston of at least one cylinder is brought into a position advantageous or necessary for the actual starting sequence. This positioning takes additional time and prolongs the starting sequence considerably. As already stated above, a longer starting time has a detrimental effect on the running dynamics and the level of comfort.

For this reason DE 198 08 472 A1 even proposes to initiate the positioning, that is to say the turning, of the crankshaft by a central locking remote control, in order thereby to avoid the time lost by the positioning necessary before each starting sequence. The principle underlying this variant makes it suitable only for restarting the internal combustion engine after leaving the vehicle and not for the urban stop-go traffic, in which a number of restarts are called for within a short time span.

In this context, the present description sets forth a method for starting an internal combustion engine according to the preamble of claim 1, which overcomes the known advantages inherent in the state of the art, the particular intention being to shorten the starting times.

This is achieved by a method for starting a direct-injection internal combustion engine equipped with an engine management system and having n cylinders, in which n pistons oscillate between a top dead center (TDC) and a bottom dead center (BDC), and a crankshaft, wherein proceeding from a stop position of the crankshaft known to the engine management system, a starting device, which sets the crankshaft in rotation, is activated in order to start the internal combustion engine, and whilst the crankshaft is still stationary fuel is injected into at least one cylinder, which is in the compression phase, and the fuel-air-mixture present in this one cylinder is ignited, thereby supporting the starting device.

In contrast to the methods known in the state of the art, the method according to the description dispenses with a positioning phase. The initiation of the combustion processes supporting the starting device is undertaken in the form of a fuel injection into at least one cylinder whilst the crankshaft is still stationary.

That is to say the injection occurs even before activation of the starting device or at the latest simultaneously with activation of the starting device. Proceeding from a known stop position of the crankshaft, fuel is injected into the cylinder, which is in the compression phase on the way to top dead center (TDC), it being also possible to inject fuel into more than one cylinder if there is more than one cylinder in the compression phase. Advantageously this is also done because the combustion gases expanding in the combustion chamber of each cylinder contribute proportionately to the drive torque exerted on the crankshaft by the gas forces and because the starting time is reduced as the number of cylinders increases.

The absence of the positioning phase shortens the starting sequence considerably, the absence of the positioning also saving the energy required for the positioning, which improves the overall efficiency of the internal combustion engine. According to the description the combustion processes initiated in the cylinders and the starting device mutually support one another, the two torques, that is to say the torque exerted on the crankshaft by the starting device on the one hand, and the torque exerted on the crankshaft by the gas forces as a result of the combustion processes on the other, are superimposed on or added to one another to form a common drive torque.

The method proposed according to the description permits rapid and in particular fuel-saving restarting, thereby also reducing the quantity of pollutants generated in the starting procedure. In a favorable scenario the support for the starting sequence through the application of an external torque by a starting device—for example a starter or a starter-generator may be terminated directly upon or shortly after reaching top dead center (TDC) for the first time. In a four-cylinder-in-line engine this generally corresponds approximately to one quarter-revolution of the crankshaft. Shortening the starting time improves the running dynamics and in particular the level of comfort due to the lower noise emissions. Since the position of the crankshaft is known when restarting commences, the correct injection timing and ignition timing are clear, so that only a very short, if any, run-in phase is required for synchronization of the engine operating parameters. The various possible ways of determining the crankshaft position on commencement of the starting process will be explored below in the connection with the preferred embodiments of the method.

The method according to the description therefore overcomes the known disadvantages inherent in the state of the art, a shortening of the starting times, in particular, being achieved.

Further advantageous embodiments of the method will be discussed in connection with the detailed description.

BRIEF DESCRIPTION OF THE DRAWINGS

The advantages described herein will be more fully understood by reading an example of an embodiment, when taken alone or with reference to the drawings, wherein.

DETAILED DESCRIPTION

Figure 1:
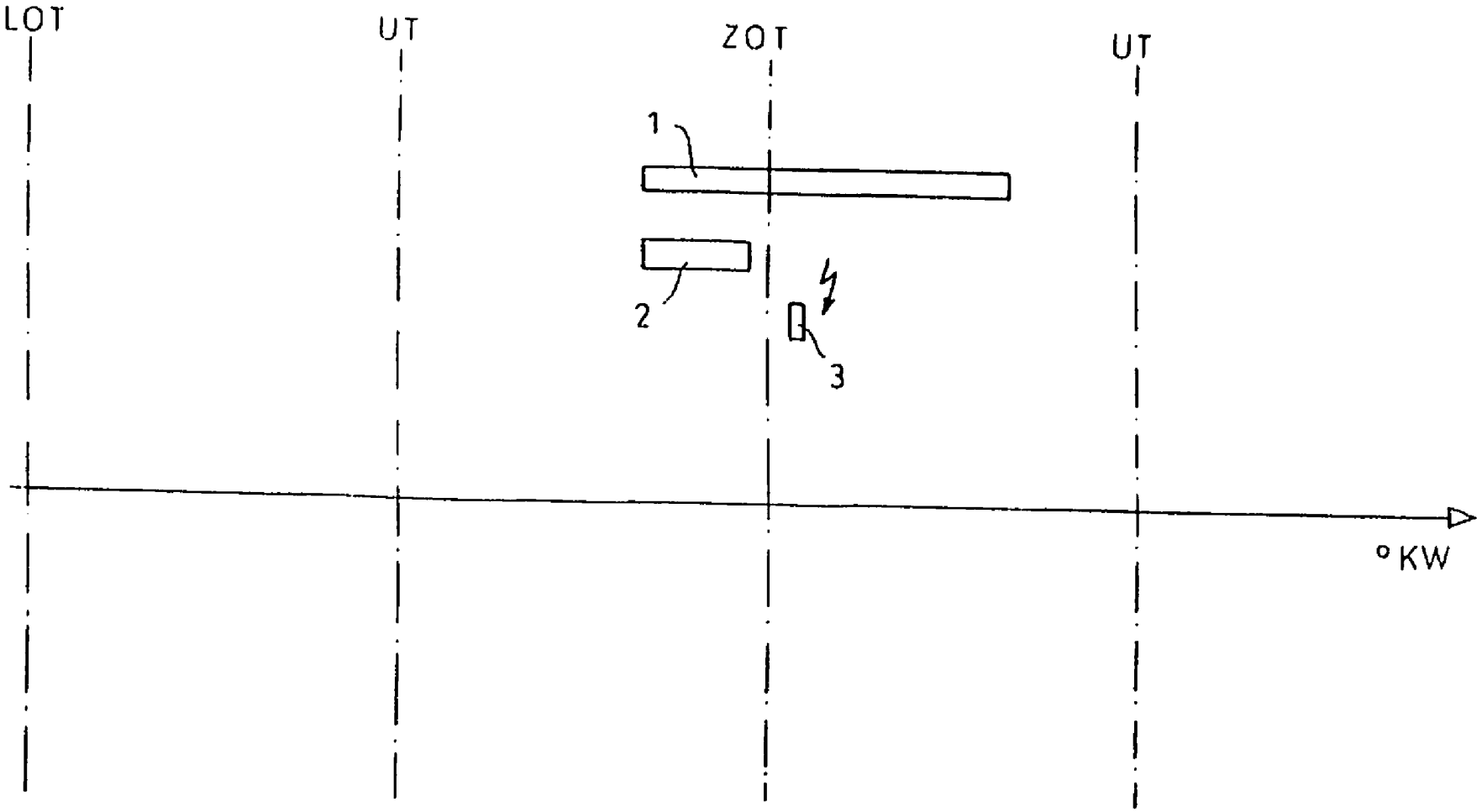
FIG. 1 shows the individual steps in the method in chronological sequence for a first embodiment of the method plotted over the crankshaft angle.

FIG. 1 shows the individual steps in the method in chronological sequence for a first embodiment of the method plotted over the crankshaft angle.

Proceeding from a stop position of the crankshaft, which is known to the engine management system and in which at least one cylinder of the internal combustion engine is in the compression phase, fuel is injected into this one cylinder whilst the crankshaft is still stationary. The piston of this one cylinder is situated between bottom dead center (BDC or UT in the figure) and ignition top dead center (TDC or ZOT in the figure).

Simultaneously with the initiation of the injection sequence, the starting device is activated, which in addition to the combustion processes initiated is intended to transmit a drive torque to the crankshaft. In the variant of the method represented in FIG. 1 the injection sequence is terminated or completed even before top dead center (TDC or ZOT in the figure) is reached. The crank angle range, in which the injection is performed, bears the reference numeral 2.

The ignition of the fuel-air mixture present in at least one cylinder occurs in the expansion phase, after the piston has passed top dead center (TDC or ZOT in the figure). The ignition is identified by the reference numeral 3.

The phase in which the starting device is activated and the starting sequence supported is identified by the reference numeral 1. The starting device is already deactivated in the first ensuing expansion phase of at least one cylinder. Subsequently the internal combustion engine is run up to the idling speed exclusively by a combustion processes initiated in the cylinders.

Figure 2:
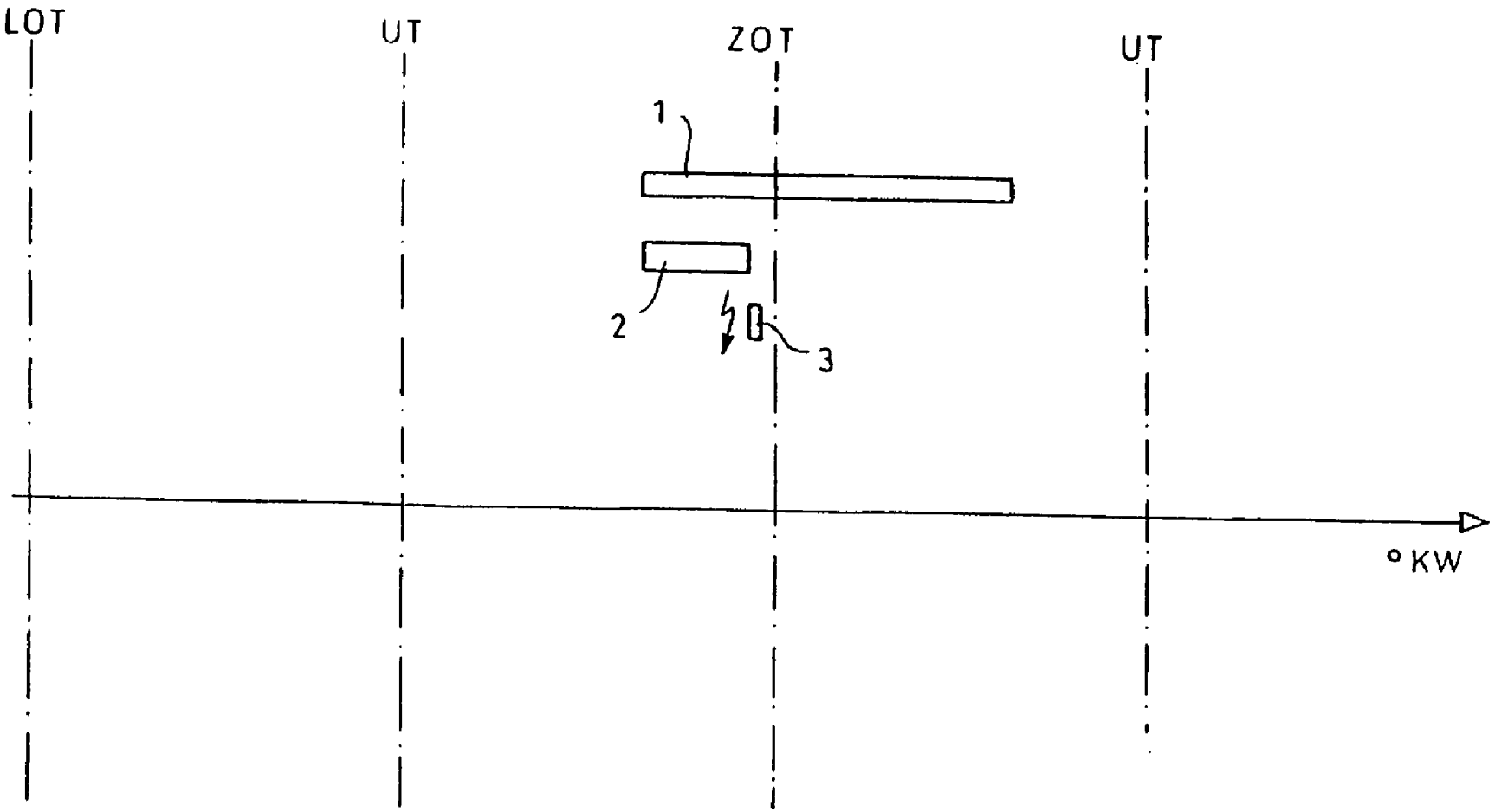
FIG. 2 shows the individual steps in the method in chronological sequence for a second embodiment of the method plotted over the crankshaft angle.

FIG. 2 shows the individual steps in the method in chronological sequence for a second embodiment of the method plotted over the crankshaft angle. It is only proposed to discuss the differences from the variant of the method represented in FIG. 1, for which reason reference is otherwise made to FIG. 1. The same reference numerals have been used.

In contrast to the exemplary embodiment according to FIG. 1, in the variant of the method according to FIG. 2 the ignition of the fuel-air mixture present in at least one cylinder already occurs in the compression phase, before the piston passes top dead center (TDC or ZOT in the figure).

Figure 3:
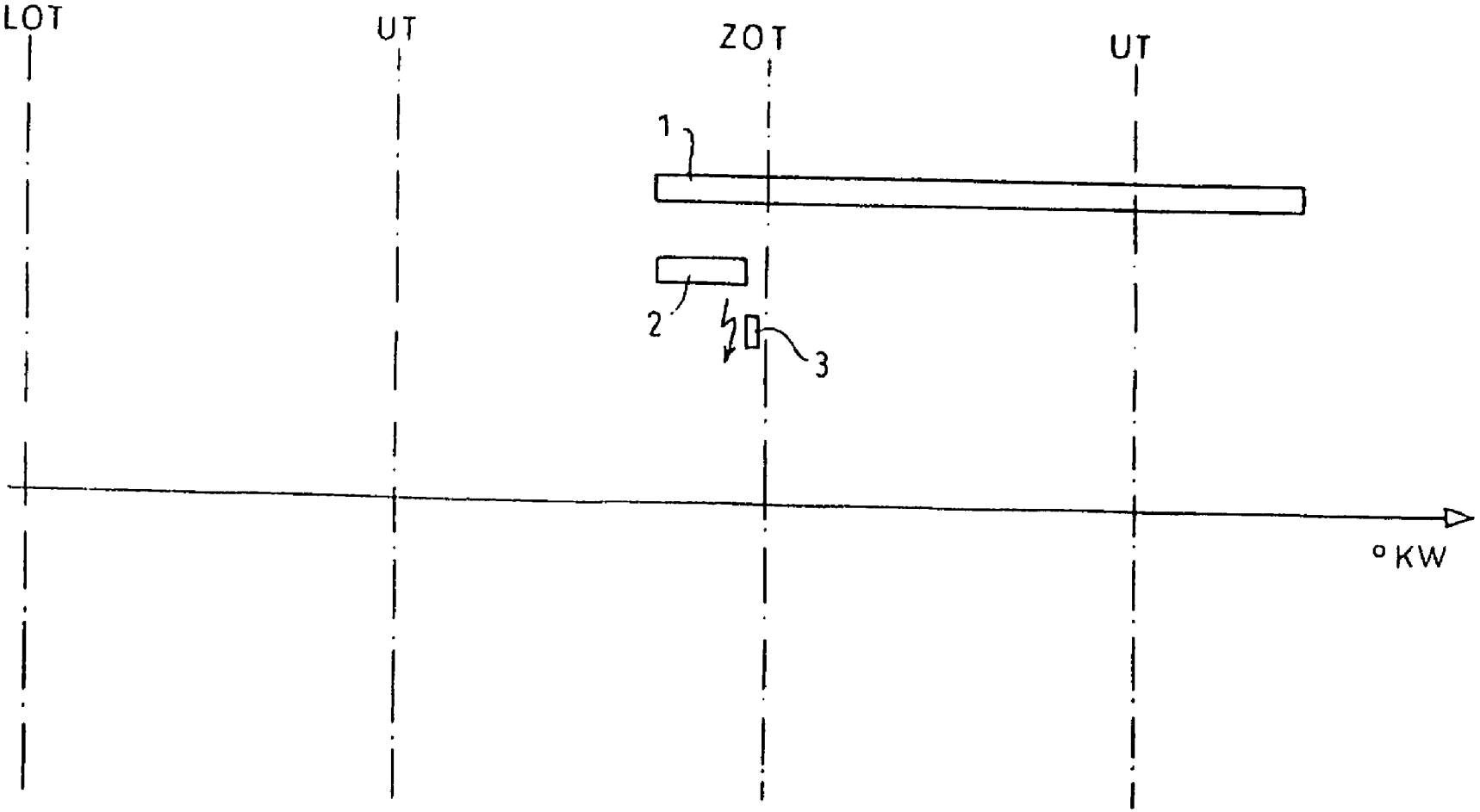
FIG. 3 shows the individual steps in the method in chronological sequence for a third embodiment of the method plotted over the crankshaft angle.

FIG. 3 shows the individual steps in the method in chronological sequence for a third embodiment of the method plotted over the crankshaft angle. It is only proposed to discuss the differences from the variant of the method represented in FIG. 2, for which reason reference is otherwise made to FIG. 2. The same reference numerals have been used.

In contrast to the exemplary embodiment according to FIG. 2 in the variant of the method according to FIG. 3 the starting device is not already deactivated in the first expansion phase of at least one cylinder, but continues to be used to support the starting sequence. In this case the starting device remains activated until a predefinable minimum number of revolutions is reached, at which a successful starting sequence or starting attempt can be assumed.

Figure 4:
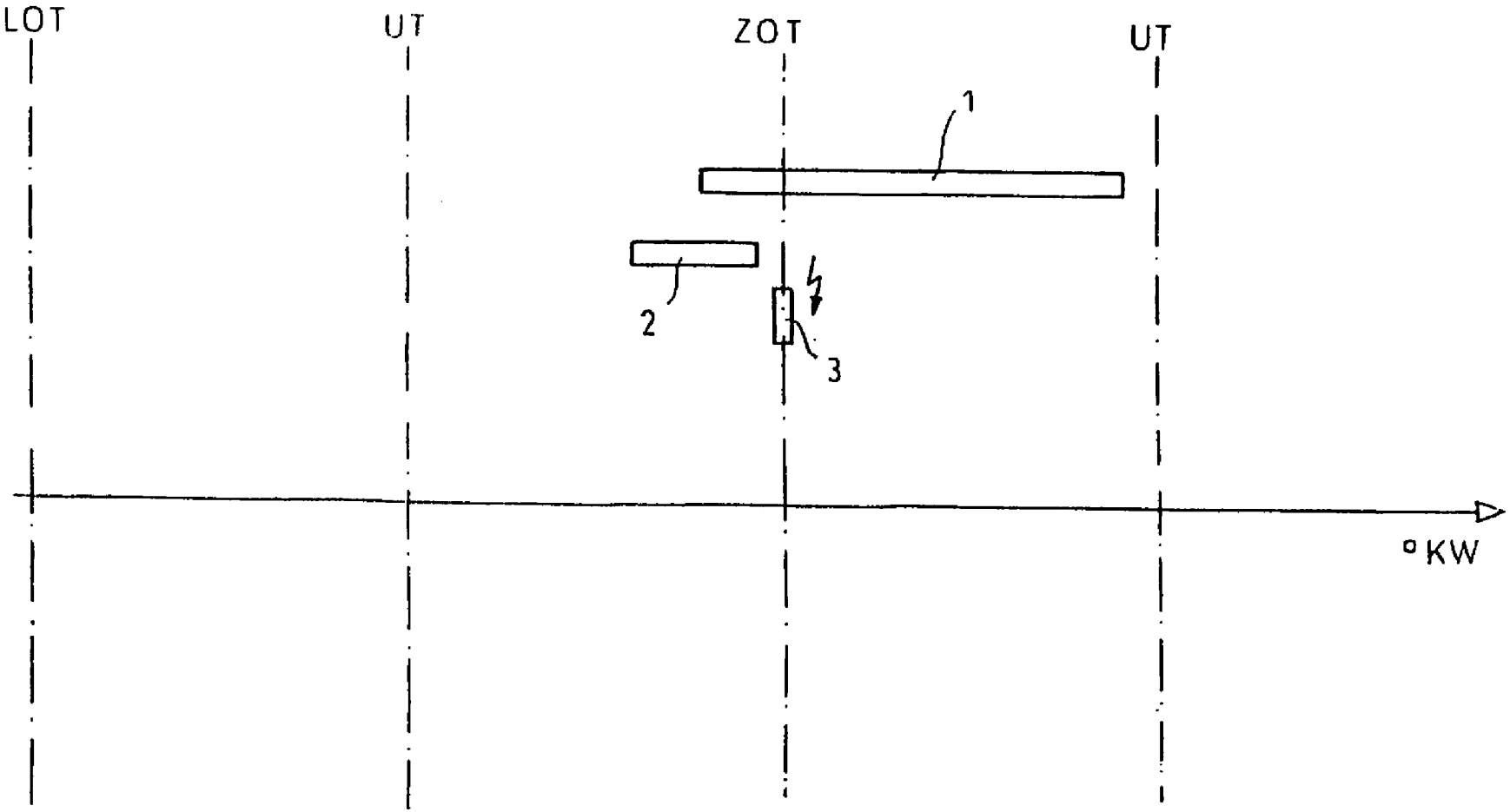
FIG. 4 shows the individual steps in the method in chronological sequence for a fourth embodiment of the method plotted over the crankshaft angle.

FIG. 4 shows the individual steps in the method in chronological sequence for a fourth embodiment of the method plotted over the crankshaft angle. It is only proposed to discuss the differences from the variant of the method represented in FIG. 1, for which reason reference is otherwise made to FIG. 1. The same reference numerals have been used.

In contrast to the exemplary embodiment according to FIG. 1 the injection sequence in the variant of the method according to FIG. 4 is already initiated before the starting device is activated. That is to say the two measures intended to forcibly set the crankshaft in rotation during the starting sequence, namely the activation of the starting device and the initiation of combustion processes, are not initiated simultaneously but with a time lag.

The ignition of the fuel-air mixture present in at least one cylinder occurs at top dead center (TDC or ZOT in the figure).

Figure 5:
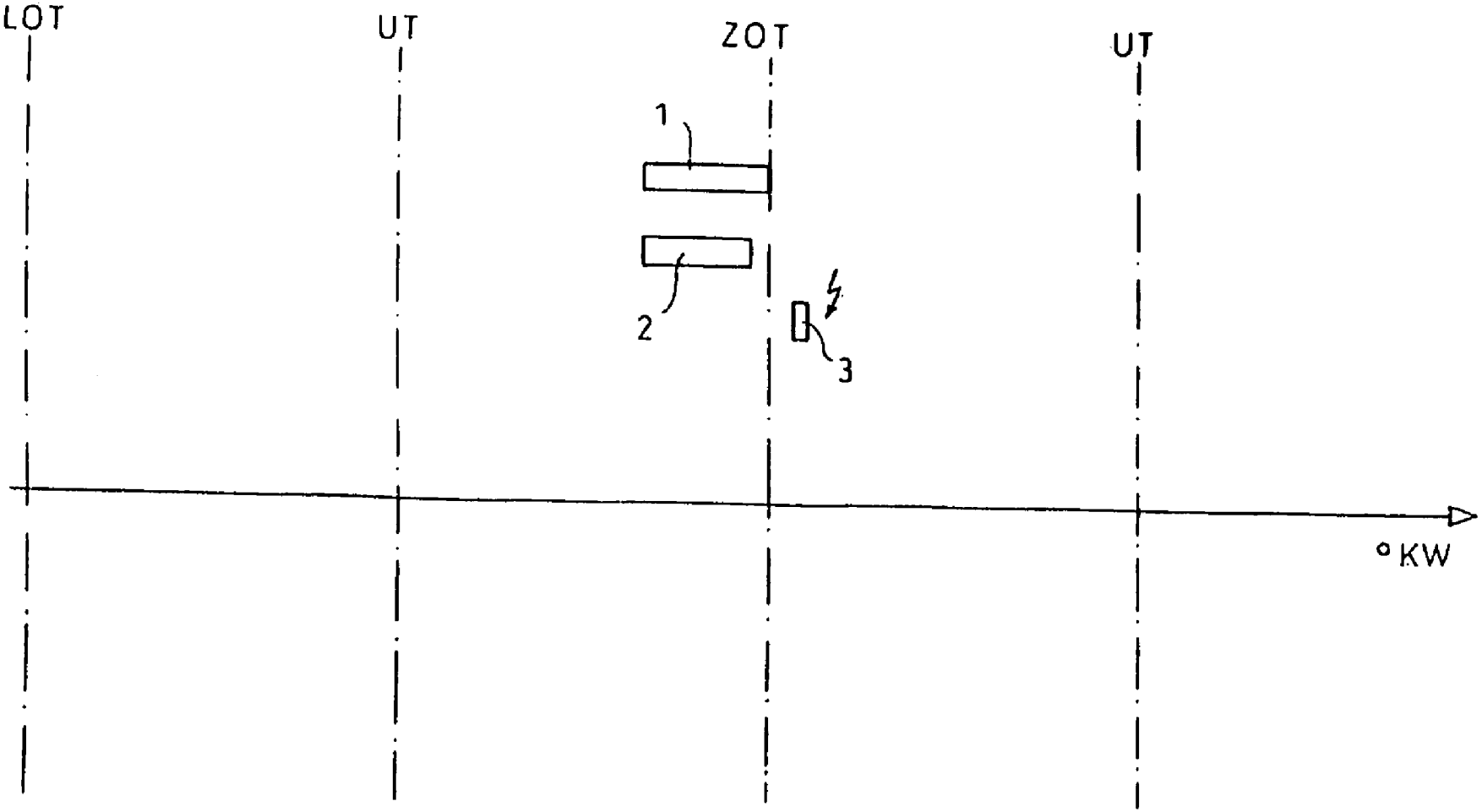
FIG. 5 shows the individual steps in the method in chronological sequence for a fifth embodiment of the method plotted over the crankshaft angle.

FIG. 5 shows the individual steps in the method in chronological sequence for a fifth embodiment of the method plotted over the crankshaft angle. It is only proposed to discuss the differences from the variant of the method represented in FIG. 1, for which reason reference is otherwise made to FIG. 1. The same reference numerals have been used.

In contrast to the exemplary embodiment according to FIG. 1 the starting device in the variant of the method according to FIG. 5 is already deactivated on reaching top dead center (TDC or ZOT in the figure) before the cylinder passes from the compression phase into the expansion phase. That is to say during the expansion phase the crankshaft, in the course of the starting sequence, is forcibly set in rotation solely by the initiation of combustion processes.

Figure 6:
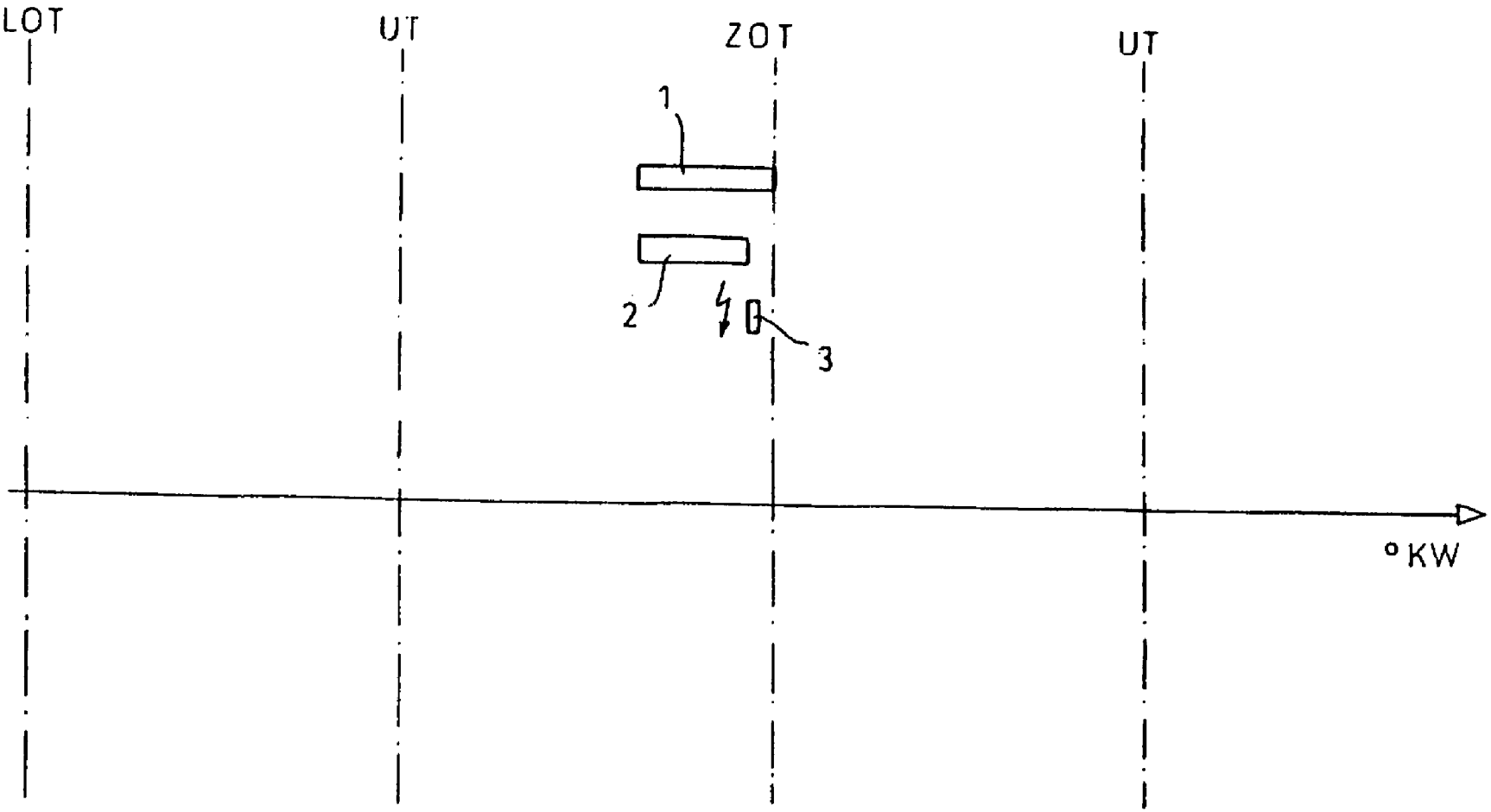
FIG. 6 shows the individual steps in the method in chronological sequence for a sixth embodiment of the method plotted over the crankshaft angle.

FIG. 6 shows the individual steps in the method in chronological sequence for a sixth embodiment of the method plotted over the crankshaft angle. It is only proposed to discuss the differences from the variant of the method represented in FIG. 2, for which reason reference is otherwise made to FIG. 2. The same reference numerals have been used.

In contrast to the exemplary embodiment according to FIG. 2 and like the previously described variant of the method according to FIG. 5, the starting device in the variant of the method according to FIG. 6 is already deactivated before reaching top dead center (TDC or ZOT in the figure), before the cylinder passes from the compression phase into the expansion phase. Consequently, as has already been explained in more detail in connection with FIG. 5, during the expansion phase the crankshaft, in the course of the starting sequence, is forcibly set in rotation solely by the initiation of combustion processes.

Advantageous embodiments of the description include those in which the known stop position of the crankshaft is a predefinable position, to which controlled running is possible after the internal combustion engine has been shut off, in that after switching off the ignition and/or the fuel supply the energy given off by the internal combustion engine before it comes to a standstill is used in a controlled manner in such a way that the crankshaft is arrested in this predefinable stop position.

This embodiment of the method is advantageous, because running to a predefinable position, in particular a preferred position, is conducive to restarting, and in particular shortens the starting time.

Such a method in internal combustion engines with direct fuel injection, for example, even allows starting without a starting device or without activation of the starting device, for which purpose fuel merely has to be injected into the combustion chambers of the stationary internal combustion engine and ignited by a spark plug, so that the firing of the air-fuel mixture sets the pistons in motion, causing the crankshaft to rotate.

This method of starting or restarting, however, requires adherence to certain boundary conditions. In particular, the crankshaft—as already mentioned—must be in a specific position or in a specific crank angle range. In this respect methods for controlled shut-off are particularly appropriate in internal combustion engines with direct fuel injection.

For example, the use of a method in which after shutting off, that is to say on ending of the regular operation of the internal combustion engine, an adjusting device is activated and actuated, which moves the crankshaft and/or the camshaft into a predefinable advantageous angular position. In this case both active and passive adjusting devices may be used.

An electric motor, which transmits a torque to the crankshaft and which after the internal combustion engine has been shut off turns this into the required position, which is then retained until the internal combustion engine is restarted, may serve as active adjusting device.

However, passive adjusting devices may likewise be used which, on ending of the regular operation of the internal combustion engine, utilize the rotational movement still present in the continued running of the crankshaft and cause the crankshaft to come to rest in the predefined advantageous crankshaft position. As passive adjusting device it is proposed to use a device consisting of a charge cycle valve timing gear, for example, which when suitably actuated transmits a braking torque to the internal combustion engine or the crankshaft, so that the retardation of the shaft and hence its final position can be controlled.

Compared to the active adjusting devices the passive adjusting devices afford the advantage that their energy consumption is generally lower and also has an acceptable value with a view to the underlying object of a fuel-saving restart, since the passive adjusting devices do not initiate a rotational movement of the crankshaft but merely rely on the principle of suitably retarding an existing rotational movement of the crankshaft.

A method of controlling the rundown of an internal combustion engine, through suitable actuation, that is to say through suitable opening and closing of the exhaust and refill valves an influence can be exerted on the combustion chamber pressure and hence on the torque which the gas forces exert on the crankshaft via the piston and the connecting rod. This method, however, assumes an internal combustion engine which has an at least partially variable valve timing.

In order to be able to run precisely to a predefined preferred position of the crankshaft, however, a large amount of information is needed. This can be done by resorting to the data already measured and/or derived for the usual engine management system, in particular to the engine speed, the crankshaft angle, the engine temperature or a temperature that correlates with this, such as the coolant temperature, and/or the intake pressure in the intake manifold. Experience shows that the said variables have the greatest influence on the rundown motion of the internal combustion engine or the crankshaft.

In connection with the running to a predefinable position it is necessary to determine how much energy is present in the powertrain after shutting off the internal combustion engine and needs to be dissipated during the rundown sequence.

A model for the rundown motion of the internal combustion engine can take account of the current kinetic energy of the powertrain, the friction losses and/or the compression and expansion processes in the cylinders of the internal combustion engine. Such a model may be obtained on the basis of theoretical considerations and implemented in the form of mathematical equations. However the model is preferably obtained wholly or at least in part by empirical means, that is to say through observation of the engine behavior and processing of the measured data obtained thereby (e.g. in the form of a lookup table).

Advantageous embodiments of the description include those in which the ignition of the fuel-air mixture present in at least one cylinder occurs at top dead center (TDC) of the piston or in the ensuing expansion phase, once the piston in that one cylinder has passed top dead center (TDC).

This serves to prevent the piston being moved and accelerated towards bottom dead center (BDC) by the gas pressure building up due to the combustion of the fuel-air mixture, before is has passed top dead center (TDC). This would impart a false direction of rotation to the crankshaft counter to its actual direction of rotation, which would make the starting sequence more difficult, and in particular would prolong it. The combustion initiated would not support the starting device, but would counteract the torque exerted on the crankshaft by the starting device, which would be counterproductive.

The proposed variant of the method is particularly advantageous in view of the fact that the rotational speed of the crankshaft at the beginning of the starting sequence is very low and the inertia of the system coming into motion together with the starting device is sometimes not sufficient, even where ignition is initiated before top dead center (TDC), to move the piston of at least one cylinder further towards top dead center (TDC) and beyond top dead center.

Advantageous embodiments of the description also include those in which the internal combustion engine is equipped with an absolute angle sensor, which even without rotation of the crankshaft supplies information on the absolute position of the crankshaft to the engine management system, so that the position of the stationary crankshaft as known stop position during a shut-down sequence does not need to be either registered or stored for the restarting of the internal combustion engine.

The absolute angle sensor detects the crankshaft position at the beginning of the starting sequence and delivers this information to the engine management system, which from this stop position of the crankshaft then known to it controls the method for starting the internal combustion engine. In this context the term "absolute", identifies that the position of a piston is clearly defined, that is to say its position on the circumference of the crankshaft within a crank angle window of 360° and moreover whether the piston is situated in the charge cycle or in the combustion cycle. As already stated above, in the state of the art this is achieved through interaction of the camshaft sensor and the crankshaft sensor.

In contrast to the sensors generally used in the state of the art, which have been discussed in detail in the introductory part of the description, the absolute angle sensor also detects the position of the stationary crankshaft. This can be achieved, for example, by arranging a ring or toothed ring on the camshaft, which on its circumference has non-uniform markings, which provide precise information on the angular position of the camshaft and hence of the crankshaft. A toothed ring, for example, in which the teeth distributed over the circumference have a different width or gaps of varying size between the teeth, may be suitable here.

The corresponding sensor then not only reads off signals from the rotating toothed ring, but also sees the position of the crankshaft when the toothed ring is stationary. Synchronization of the injection timing and the ignition timing is nor necessary or is considerably shortened. Furthermore it does not matter if the information or data on the crank angle position filed in the engine management system is lost—for example in the event of a failure of the power supply.

Advantageous embodiments of the method, however, also include those in which the internal combustion engine is equipped with an absolute angle sensor, which with the crankshaft rotating delivers information on the absolute position of the crankshaft to the engine management system until the crankshaft comes to rest, and the position of the stationary crankshaft is stored by the engine management system as known stop position of the crankshaft for the restarting of the internal combustion engine.

The sensor used must be capable of tracking or registering the position of the crankshaft until the crankshaft comes to rest. It must therefore also have the capacity to be able to detect any reversely directed rotational movements, as could occur at the end of the rundown sequence of the crankshaft. Only in this way can it be ensured that the position of the crankshaft is detected with sufficient accuracy and that this crank angle position is available as known stop position for a subsequent starting or restarting.

Advantageous embodiments of the description include those in which the starting device is deactivated during the first expansion phase of at least one cylinder, that is to say once the piston of at least one cylinder has passed top dead center (TDC) and before the piston of that one cylinder reaches bottom dead center (BDC).

In this variant of the method the internal combustion engine, following the relatively early deactivation of the starting device, is run up to the idling speed of approximately 700 rpm solely by the combustion processes initiated in the combustion chambers of the cylinders. The early deactivation of the starting device reduces both the energy consumed by the starting device and the noise emitted by the starting device, that is to say restarting which is as fuel-saving, quiet and comfortable as possible.

Advantageous embodiments of the method, however also include those in which the starting device remains activated for at least one revolution of the crankshaft. This ensures that the starting sequence is completed successfully.

Advantageous embodiments of the description also include those in which the starting device is only deactivated on reaching a predefinable minimum number of revolutions. This variant is also aimed at ensuring a reliable starting of the internal combustion engine.

Advantageous embodiments of the description also include those in which a starter is used as starting device. Where a starter is used as starting device, the method is also suitable for retrofitting to internal combustion engines and vehicles already on the market and equipped with a starter, since then it is only necessary to make modifications to the control programs of the engine management system in order to be able to operate the internal combustion engine when starting in accordance with the method according to the description. Where necessary, an absolute angle sensor must be provided in order to be able to determine the absolute position of the crankshaft necessary for the starting sequence.

Advantageous embodiments of the description also include those in which a starter-generator is used as starting device. A so-called starter-generator combines the functions of a conventional starter and a generator or an alternator.

A combined Starter-Generator is advantageous firstly having regard to the stop-go traffic, which requires start-stop operation and hence a correspondingly high number of restarts, and secondly having regard to the increased demand for electrical power as a result of increasing levels of vehicle comfort and the additional electrical systems which this necessitates.

In generator operation, the starter-generator in the lower rotational speed range is preferably driven by way of an intermediate transmission at rotational speeds of the internal combustion engine sufficient for the generation of power and used to generate power, whereas in the starting sequence the starter-generator forcibly turns, that is to say drives the internal combustion engine at low rotational speeds and high torque.

It is possible to use so-called integrated starter-generators (ISGs), and also so-called ISAD starter-generators (Integrated Starter Alternator Damper) or the like. The ISAD, which is also referred to as a crankshaft starter-generator, combines the functions of a starter, an alternator and a vibration absorber. The system comprises an electrical machine, which surrounds the crankshaft between engine and transmission in place of the flywheel.

In internal combustion engines, which are equipped with an at least partially variable valve timing, advantageous embodiments of the method include those in which the at least partially variable valve timing is controlled in such a way that at least the first operating cycle of at least one cylinder is performed with reduced compression.

A reduced compression can be achieved by suitable valve timings. For example, early closing of the inlet valve makes it possible to reduce the fresh cylinder charge, which leads to a reduced pressure in the combustion chamber in the compression phase. Another possibility is to increase the valve overlap or to delay closing of the inlet valves with the aim of expelling a proportion of the fresh intake charge again before it can take part in the combustion. The procedure also leads to a reduced cylinder pressure in the compression phase during starting.

Regardless of the method selected, a reduced compression, that is to say a reduced cylinder pressure, leads to a reduction in the necessary drive torque, which has to be applied for successful starting of the internal combustion engine. This procedure consequently also leads to a fuel saving in the course of the starting sequence.

Advantageous embodiments of the method in this case include those in which the compression of at least one cylinder is increased in several stages during the starting sequence.

This variant of the method takes account of the fact that—assuming a deactivated starting device—a rotating crankshaft and the components pivotally connected thereto also gain inertia as the rotational speed increases and that as the rotation of the crankshaft continues the number of cylinders in which combustion processes are initiated, thereby supporting the starting sequence, likewise increases. This shows that as the rotational speed increases and the rotational movement of the crankshaft progresses it is also possible to compress a larger fresh cylinder charge, without running the risk of a reverse rotation of the crankshaft. For this reason a progressive increase in the compression, that is to say the cylinder pressure or the fresh cylinder charge, is to be preferred.

Advantageous embodiments of the description include those in which in order to support the starting sequence, fuel is injected into at least one cylinder, which is in the expansion phase, whilst the crankshaft is still stationary, and the fuel-air-mixture present in this one cylinder is ignited, thereby supporting the starting sequence.

The invention claimed is:

1. A method for starting a direct-injection internal combustion engine equipped with an engine management system and having more than one cylinder in which pistons oscillate in the cylinders between a top-dead-center position and a bottom-dead-center position, the method comprising:

reducing the compression ratio of at least a cylinder of an internal combustion engine for at least a first cycle of said at least a cylinder;

starting to inject fuel into said at least a cylinder of said internal combustion engine before said internal combustion engine is rotated, said cylinder in a compression phase;

rotating said internal combustion engine by engaging an engine starting device after said start of fuel injection; and combusting said fuel in said cylinder while said starting device is engaged.

2. The method of claim 1 further comprising initiating a spark in said cylinder before the piston of said cylinder reaches top-dead-center of said cylinder.

3. The method of claim 1 further comprising initiating a spark in said cylinder before or after the piston of said cylinder reaches top-dead-center of said cylinder.

4. The method of claim 1 wherein said starting device is a starter.

5. The method of claim 1 wherein said starting device is a starter-generator.

6. The method of claim 1 further comprising injecting fuel into a second cylinder, different from said cylinder, said second cylinder in an expansion phase, and combusting fuel in said second cylinder.

7. The method of claim 1 further comprising disengaging said starting device after the piston in said cylinder passes top-dead-center and before reaching bottom-dead-center.

8. The method of claim 1 further comprising determining the position of said engine before injecting said fuel.

9. A method for starting a direct-injection internal combustion engine equipped with an engine management system and having more than one cylinder in which pistons oscillate in the cylinders between a top-dead-center position and a bottom-dead-center position, the method comprising:

reducing the compression ratio of at least a cylinder of an internal combustion engine for at least a first cycle of said at least a cylinder;

starting to inject fuel into at least a cylinder of said internal combustion engine before said internal combustion engine is rotated, said cylinder in a compression phase;

rotating said internal combustion engine by engaging an engine starting device after said start of fuel injection; and increasing said compression ratio of at least said cylinder after said first cycle of said at least a cylinder.

10. The method of claim 9 further comprising initiating a spark in said cylinder before the piston of said cylinder reaches top-dead-center of said cylinder.

11. The method of claim 9 further comprising initiating a spark in said cylinder before or after piston in said cylinder reaches top-dead-center of said cylinder.

12. The method of claim 9 wherein said starting device is a starter.

13. The method of claim 9 wherein said starting device is a starter-generator.

14. The method of claim 9 further comprising stopping the injection of said fuel before said piston reaches top-dead-center of said compression phase.

15. A system for starting an internal combustion engine having injectors to inject fuel directly into the cylinders of the engine, the system comprising:

at least an injector having a nozzle positioned in a cylinder of an internal combustion engine;

a variable valve timing apparatus;

a starting device to rotate said engine during starting of said engine; and an engine management system to reduce a compression ratio of a cylinder by adjusting said variable valve timing apparatus, and to start to inject fuel into said cylinder of said internal combustion engine before rotating said engine, said cylinder in a compression phase, and to rotate said engine by engaging an engine starting device after said start of fuel injection, and to combust said fuel by initiating a spark in said cylinder while said starting device is engaged.

16. The system of claim 15 further comprising an absolute angle sensor for providing engine position information when said engine is rotating, and wherein said controller stores said angle information when said engine is stopped.

17. The system of claim 15 wherein said starting device is a starter-generator.

18. The system of claim 15 further comprising variable valve timing, wherein said engine management system controls said variable valve timing to reduce cylinder compression.

* * * * *